US008152024B2

(12) United States Patent
Njaastad et al.

(10) Patent No.: US 8,152,024 B2
(45) Date of Patent: Apr. 10, 2012

(54) APPARATUS FOR ATTACHING A DRIP TRAY TO A BEVERAGE DISPENSER

(75) Inventors: David K. Njaastad, Palatine, IL (US); Wieslaw Tomzyk, Wheeling, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 454 days.

(21) Appl. No.: 12/381,876

(22) Filed: Mar. 16, 2009

(65) Prior Publication Data

US 2009/0236364 A1 Sep. 24, 2009

Related U.S. Application Data

(60) Provisional application No. 61/070,222, filed on Mar. 20, 2008.

(51) Int. Cl.
*B67D 1/16* (2006.01)

(52) U.S. Cl. ..... 222/108; 222/129.1; 137/312

(58) Field of Classification Search ..... 222/108, 222/146.6, 129.1–129.4, 130, 144.5; 137/312–314
See application file for complete search history.

(56) References Cited

U.S. PATENT DOCUMENTS

| | | | | |
|---|---|---|---|---|
| 4,592,490 | A * | 6/1986 | McMichael | 222/129.1 |
| 4,615,466 | A * | 10/1986 | Credle, Jr. | 222/129.1 |
| 5,397,032 | A * | 3/1995 | Landers | 222/146.6 |
| 5,492,250 | A * | 2/1996 | Sardynski | 222/108 |
| 5,660,307 | A * | 8/1997 | Schroeder et al. | 222/108 |
| 5,829,646 | A * | 11/1998 | Schroeder et al. | 222/241 |
| 6,827,409 | B2 * | 12/2004 | Michael | 312/223.3 |
| 7,934,670 | B2 * | 5/2011 | Ford | 241/30 |
| 2006/0071015 | A1 * | 4/2006 | Jablonski et al. | 222/1 |
| 2008/0277420 | A1 * | 11/2008 | Edwards et al. | 222/129.1 |

* cited by examiner

*Primary Examiner* — Frederick C. Nicolas
(74) *Attorney, Agent, or Firm* — Pyle & Piontek, LLC

(57) ABSTRACT

A drip tray is attached to a beverage dispenser below a splash panel of the dispenser by a releasable latching mechanism that permits the drip tray to be removed from and replaced on the dispenser while the splash panel remains in place on the dispenser.

6 Claims, 5 Drawing Sheets

APPARATUS FOR ATTACHING A DRIP TRAY TO A BEVERAGE DISPENSER

This application claims benefit of provisional patent application Ser. No. 61/070,222, filed Mar. 20, 2008.

FIELD OF THE INVENTION

The present invention relates to beverage dispensing machines, and in particular to improvements in mounting a drip tray on a beverage dispensing machine.

BACKGROUND OF THE INVENTION

Combination ice and beverage dispensers typically have several beverage dispensing valves, one or more ice dispensing chutes carried on a front of the dispenser above a splash panel and a drip tray located beneath the splash panel. Such dispensers also include an ice retaining bin having a motor driven agitator for delivering ice on demand from the bin to and through the ice dispense chute(s) and to a cold plate located beneath the bin and used to chill beverage components delivered to the dispensing valves. The drip tray serves as a platform on which a receptacle, such as a cup, can be placed and supported as it is being filled with ice and beverage. The drip tray support surface usually comprises a wire grate to allow spilled beverage to flow through the grate to a lower drain. The drip tray also collects condensate, extra ice from the ice chute(s), and any material that drips from the valves. The drip tray has a drain tube that extends from the bottom of the drip tray to an external drain.

The beverage dispensing valves and ice dispensing chute (s) typically are mounted on a front of the beverage dispenser beneath a merchandising cover and above and at least partially over an upper end of a splash panel that is located beneath the merchandising cover and extends between downward to the drip tray. To service the agitator motor or access beverage tubing or other internal components within a housing of the dispenser, it is necessary to remove the splash panel and drip tray to provide access to the interior of the housing. Conventional beverage dispenser designs usually require the splash panel to be removed first, while the drip tray remains fixed in position, since the locking mechanism attaching the drip tray to the dispenser is located behind the splash panel, and the splash panel must be removed to accommodate access to and manipulation of the locking mechanism to release the drip tray from the dispenser. When the dispensing valves are of a type having operator actuable dispensing arms or levers that extend downward from the valves and over an upper portion of the splash panel, it can be difficult to remove and replace the splash panel without striking the arms and damaging the valves. Also, during disassembly and reassembly, the drip tray locking mechanism can be difficult to manually access and manipulate due to a lack of space in the front of the beverage dispenser housing.

OBJECT OF THE INVENTION

A primary object of the present invention is to provide improvements in mounting a drip tray on a beverage dispenser, which permit the drip tray to be removed from and replaced on the dispenser without first removing a splash panel of the dispenser.

SUMMARY OF THE INVENTION

In accordance with the present invention, a beverage dispenser comprises a housing; a beverage dispensing valve on a front of the housing; a splash panel removably mounted on the front of the housing below the beverage valve; and a drip tray removably mounted on the front of housing beneath the beverage valve and splash panel by releasable attaching means, so that the drip tray can be mounted on and dismounted from the housing while the splash panel remains mounted on the housing.

The beverage valve includes a valve actuating arm extending downward at least partially across a front of the splash panel, and upon removal of the drip tray from the housing the splash panel can be removed by being moved downward through a space previously occupied by the drip tray without contacting either the valve actuating arm or the drip tray. The releasable attaching means comprises interacting means on each of a back side of the drip tray and a front side of the dispenser housing for releasably attaching the drip tray to the housing while the splash panel is on the housing, such that upon manually moving the drip tray toward the housing the interacting means on each of the drip tray and housing engages to releasably attach the drip tray to the housing, and upon manually moving the drip tray away from the housing the interacting means on each of the drip tray and housing disengages to permit removal of the drip tray from the housing.

In a preferred embodiment the interacting means includes spring loaded detent means, such as spring loaded ball means on one of the drip tray and dispenser housing and detent means on the other of the drip tray and dispenser housing. In the case of the interacting means being string loaded detent means, the housing can have at least one channel extending rearward from a front thereof and the drip tray can have at least one arm extending rearward from a rear thereof, and the spring loaded ball means is associated with one of, and the detent means is associated with the other of, the at least one housing channel and the at least one drip tray arm. Advantageously, the housing can have a pair of laterally spaced guide channels extending rearward from a front of the housing and the drip tray can have a pair of arms extending rearward from a back of the drip tray and extendable into associated ones of the housing guide channels upon movement of the drip tray toward the housing, and the releasable attaching means comprising means on the drip tray arms and dispenser housing guide channels releasably attaches the drip tray to the housing when the arms are extended into the guide channels and releases the drip tray from the housing when the arms are pulled out of the guide channels.

It is contemplated that the releasable attaching means can comprise flexible clip means.

The invention also contemplates a method of releasably attaching a drip tray to a beverage dispenser having a housing, a beverage dispensing valve on a front of the housing and a splash panel removably mounted on the front of the housing below the beverage valve. The method comprises the steps of providing on each of a back side of the drip tray and a front side of the dispenser housing interacting latching components that when brought together releasably attach the drip tray to the dispenser housing below the splash panel and that when moved apart release the drip tray from the dispenser housing; and moving the drip tray toward the dispenser housing while the splash panel is on the housing to bring together the interacting latching components to releasably attach the drip tray to the housing. Also included is the step of removing the drip tray from the dispenser housing, while the splash panel is on the housing, by moving the drip tray away from the housing to separate the interacting latching components and release the drip tray from the housing.

In a preferred practice of the method, the beverage valve has a valve actuating arm extending downward least partially over a front of the splash panel, so that upon removal of the drip tray, the splash panel can be removed from the dispenser housing by being moved downward through a space previously occupied by the drip tray without contacting either the valve actuating arm or the drip tray.

In one practice of the method, the interacting components include a spring loaded detent. In another practice, the interacting components include a flexible clip.

The foregoing and other objects, features and advantages of the invention will become apparent upon a consideration of the following detailed description, when taken in conjunction with the accompanying drawings.

DETAILED DESCRIPTION

Figure 1:
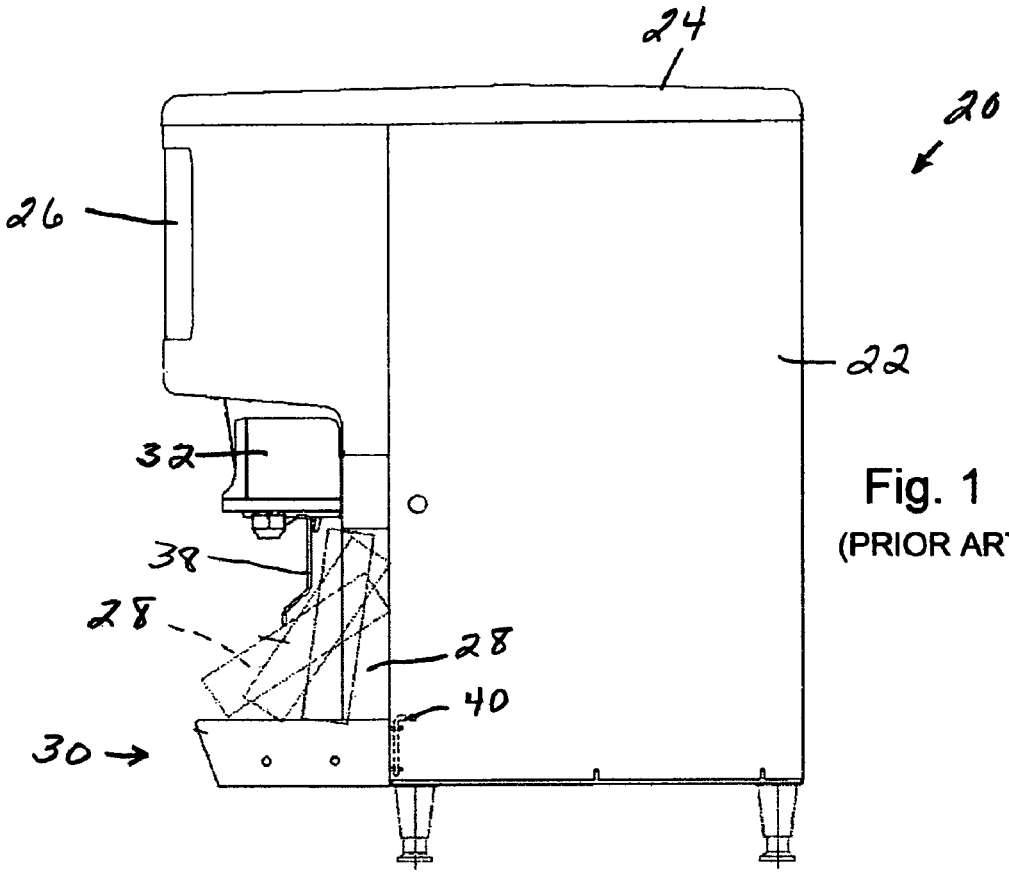
Fig. 1 (PRIOR ART)
FIG. 1 is a side elevation view of an ice and beverage dispenser, showing a conventional technique for securing a drip tray to the dispenser.

The present invention is for use with an ice and beverage dispenser, such as an ice and beverage dispenser of the general type indicated at 20 in the drawings. The dispenser is adapted to rest on a countertop or other suitable surface and includes an external housing 22 within which is a hopper or bin for holding a quantity of ice pieces, an agitator motor below the bin for rotating an agitator in the bin, tubing for liquid beverage components, electrical wiring, etc. A lid or cover 24 is over an upper opening to the housing and is removable to accommodate access to an open upper end of the bin for filling the bin with ice. A front face of the dispenser includes a merchandising cover 26, a splash panel 28 and a drip tray, indicated generally at 30, located below the splash panel. Mounted on the front of the dispenser below the merchandising cover and generally above the splash panel are a plurality of beverage dispensing valves 32 and one or more ice dispensing chutes 34. A user actuable ice dispense arm 36 extends downward from each ice dispensing chute 34 and is adapted to be moved rearward by a cup placed beneath the ice chute to open the chute for a flow of ice from the bin, through the chute and into the cup. A user actuable beverage dispense arm 38 extends downward from each beverage dispensing valve 32 and is adapted to be moved rearward by a cup placed beneath the valve to open the valve to dispense beverage into the cup.

As is conventional, the drip tray 30 is at the lower front of the ice/beverage dispenser 20, substantially immediately beneath the splash panel 28 and below the ice dispensing chutes 34 and beverage dispensing valves 32. The drip tray includes an upper horizontally extending removable cup rest or metal grate that rests on an upper perimeter edge of side walls of the drip tray. A drip tray volume or interior space is defined within the drip tray below the grate and within the perimeter walls above a bottom drain surface of the drip tray. The bottom drain surface serves to direct to a drain waste fluid as may enter the drip tray, such as condensate, extra ice from the ice chutes and material that drips from the beverage valves.

As is understood by those of skill in the art, it is necessary to remove the splash panel 28 to gain access to and service the agitator motor, beverage tubing and/or other components of the ice and beverage dispenser 20 that are located within the interior of the housing 22 behind the splash panel. Conventionally, the splash panel must be removed while the drip tray remains fixed in position on the beverage dispenser, since known techniques for attaching a drip tray to a dispenser utilize lock pins 40 (FIGS. 1 and 5A) or other types of mechanical devices that are located behind the splash panel and can be manually accessed and manipulated to release the drip tray from the dispenser only following removal of the splash panel. A disadvantage to the arrangement is that removal of the splash panel with the drip tray in position requires that screws (not shown) be removed from the splash panel to release it from the housing 20 and that, as seen in FIG. 1, the splash panel then be pulled outward from its bottom, while being tilted or rotated, such that its lower rearward edge is slid forward along the top of the drip tray grate while its upper rearward edge is slid downward along front side portions of the housing until the splash panel dears lower ends of the beverage valve dispense arms 38 and can be pulled away from the dispenser. However, as seen in FIG. 1 the beverage valve actuating arms 38 extend a considerable distance downward in front of the splash panel and in removing the splash panel it can be difficult, if not impossible, to prevent a front face of the splash panel from contacting and forcing the dispense valve actuating arms forward away from the dispenser, in a direction in which they are not intended to move, resulting in damage to the dispense valves. The conventional procedure for removing the splash panel can also result in damage to the drip tray should the splash panel be forced downward against the drip tray during its removal in an effort to avoid contacting the beverage valve actuating arms with the splash panel.

Figure 2:
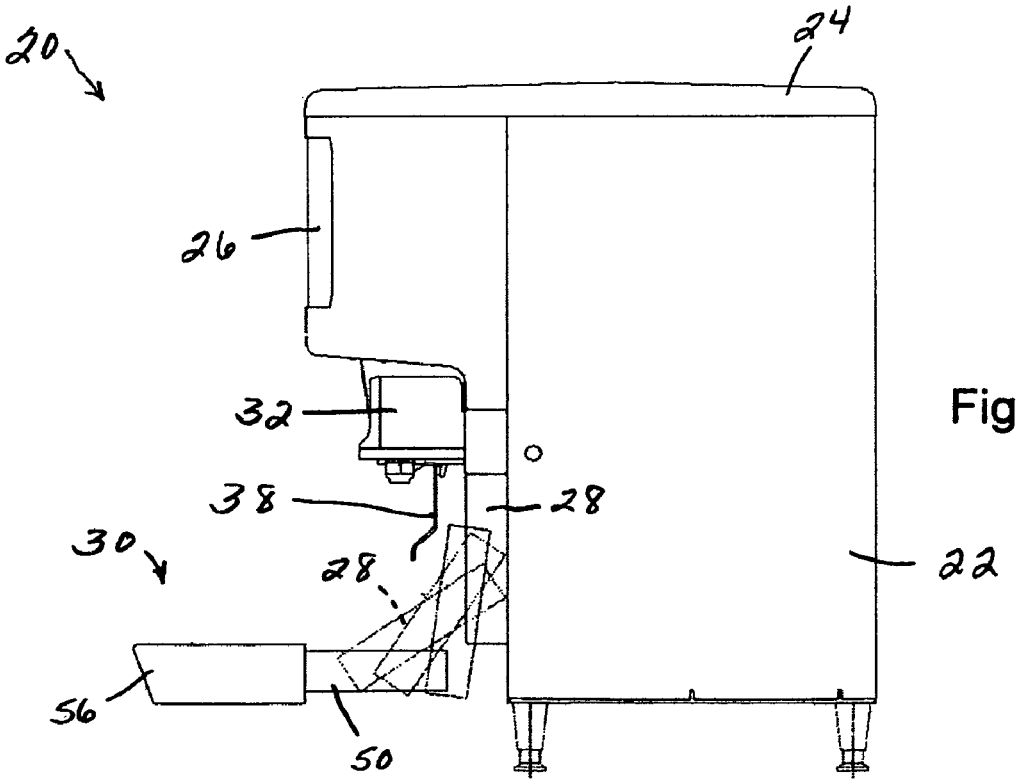
FIG. 2 is a side elevation view of the ice and beverage dispenser, showing in accordance with the invention the manner in which a splash plate can be removed from the dispenser after the drip tray is first detached and moved forward away from the dispenser.
Figure 3:
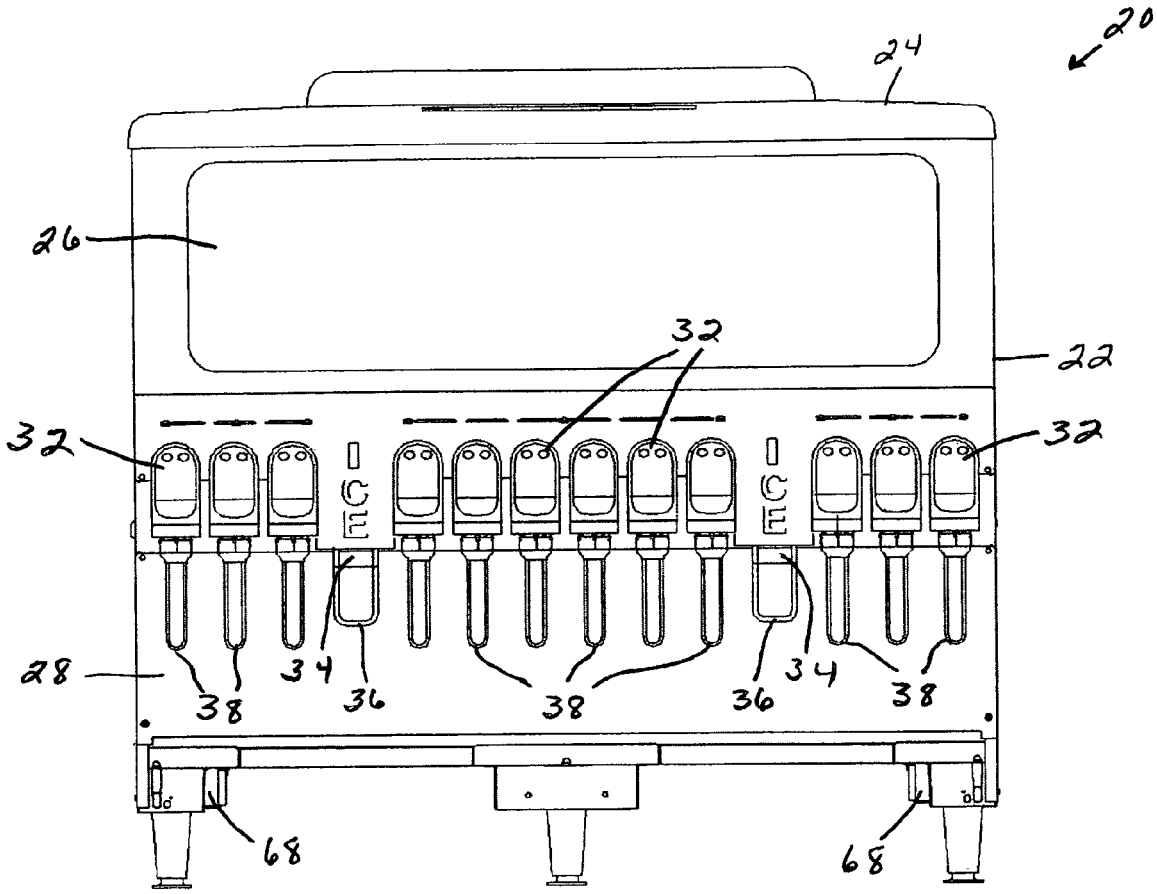
FIG. 3 is a front elevation view of the dispenser, showing guide channels on the dispenser for use in attaching a drip tray to the dispenser in accordance with one embodiment of the invention.

As seen in FIG. 2, the invention contemplates that the disadvantage of potentially damaging the beverage valves 32 and/or the drip tray 30 during removal of the splash panel 28 can be obviated by first removing the drip tray from the ice and beverage dispenser 20 before the splash panel is removed, and not vice versa. Prior removal of the drip tray would then provide room to move the splash panel downward and away from the beverage valve dispense arms 38 during its removal, thereby avoiding contact with the arms, while at the same time the drip tray would be out of harms way.

In improving upon conventional techniques for attaching a drip tray to a beverage dispenser, the invention advantageously allows a user to remove the drip tray from the dispenser without first having to uninstall other components of the dispenser, and in particular without having to first remove the splash panel. In a preferred embodiment, this is accomplished by providing each opposite back side end of the drip tray with a rearward extending arm and the dispenser with a pair of guide channels into which the drip tray arms may be slid to mount the drip tray the dispenser. A releasable detent or other mechanism is formed as part of one or the other or both of the drip tray arms and housing guide channels, and the holding force of the detent is such that it can be overcome by gripping and pushing or pulling or by otherwise manipulating the drip tray, without need to first remove the splash panel, so that the drip tray can be attached to and detached from the dispenser housing while the splash panel remains in place. Thus, the drip tray can be removed and replaced without having to disassemble any other component of the dispenser, which simplifies initial installation of the dispenser, since the splash panel no longer needs to be removed in order to set the drip tray in place. In addition, the ability to be able to conveniently remove the drip tray without having to remove of the splash panel simplifies servicing a dogged drain tube leading from the drip tray and keeping the drip tray dean.

Figure 4A:
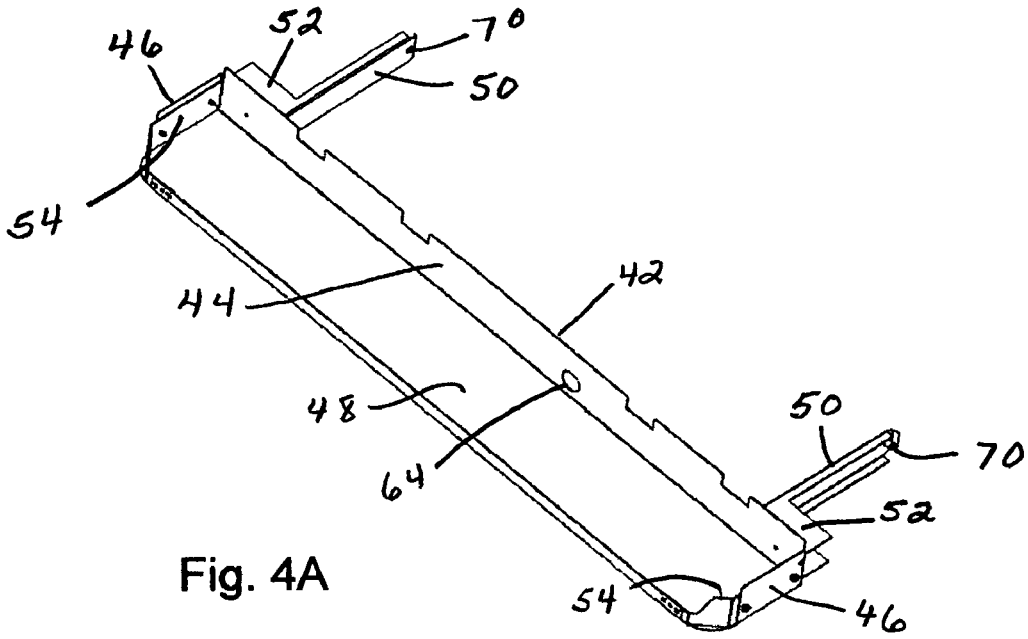
FIGS. 4A and 4B show the structure of a drip tray configured for mounting on the dispenser of FIG. 3.
Figure 4B:
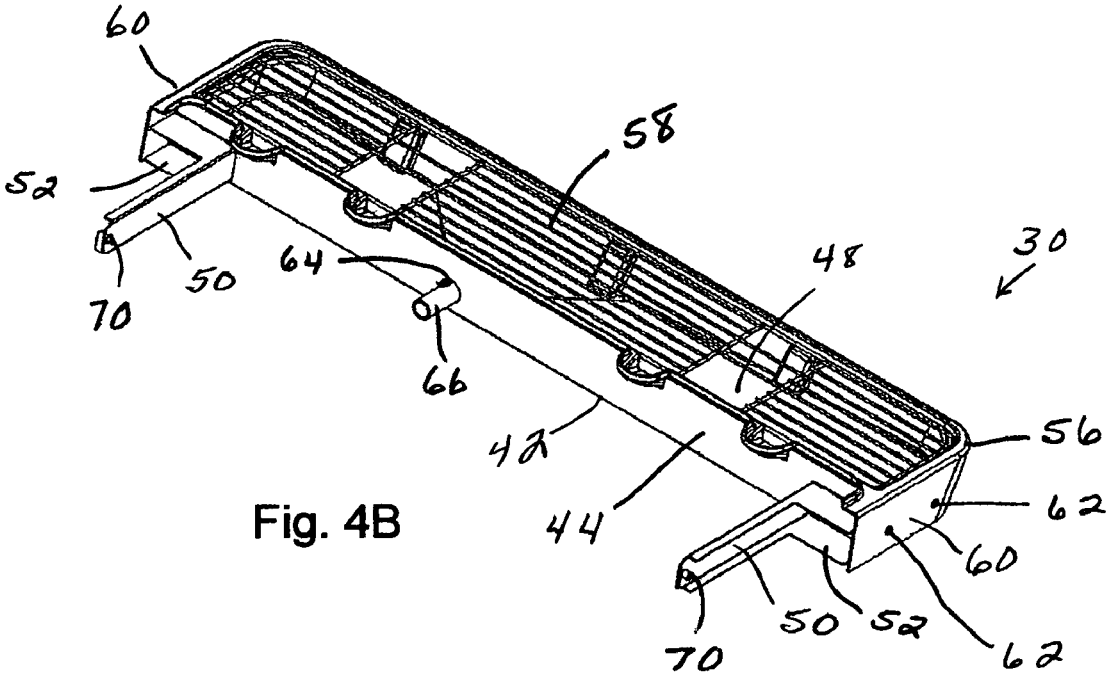

With reference to FIGS. 4A and 4B, the drip tray 30 includes an elongate frame member 42 having a back wall 44, side walls 46 and a bottom wall 48. In accordance with one embodiment of the invention, apparatus for releasably attaching the drip tray to the dispenser 20 includes a pair of arms 50 each having at its forward end a bracket portion 52 that extends toward an associated side wall 46 at a right angle from the arm and parallel to and abutting the back wall 44, and a plate portion 54 extends forward from an outer end of each bracket portion 52. The plate portion 54 of each arm 50 extends from the bracket portion 52 forward through a space between a side end of the back wall 44 and the adjacent side wall 46, and then along, abutting and parallel to the side wall. A drip tray outer cover 56 is positioned around the frame member 42 and defines an upper horizontal cup rest or grate 58, and side walls 60 of the drip tray outer cover extend across and adjacent to outer sides of the frame side walls 46. The cover 56, frame 42 and arms 50 are connected by fasteners 62 extended through aligned passages in each of the cover side walls 60, the frame side walls 46 and the arm plates 54. As assembled, the arms 50 extend rearward from the drip tray back wall 44. An opening 64 in the back wall 44 accommodates passage of tubing 66 that carries liquids from the drip tray bottom wall 48 to a drain.

To mount the drip tray 30 on the dispenser 20 while the splash panel 28 remains on the dispenser, the pair of drip tray arms 50 is extended rearward into associated ones of a pair of arm guide channels 68 located at lower front sides of the dispenser. The arrangement is such that as the drip tray is moved toward the dispenser to move the drip tray arms 50 into and through the dispenser arm guide channels 68, upon the drip tray abutting the dispenser and the arms being fully extended into the arm guide channels, according to the invention a releasable latching means engages with the drip tray arms to releasably hold the drip tray in position on the dispenser. However, the arrangement also is such that attachment of the drip tray to the dispenser by the releasable latching means can be overcome by manually pulling the drip tray forward away from the dispenser, whereby the drip tray can be attached to and removed from the dispenser while the splash panel remains mounted on the dispenser. Thus, in practice of the invention, attachment of the drip tray to and removal of the drip tray from the beverage dispenser 20 advantageously does not require removal and reinstallation of the splash panel 28.

A preferred embodiment of releasable latching mechanism is shown in FIGS. 4A, 4B, 5E, 6 and 7. Here, the drip tray arms 50 each have a passage toward their rearward end, in each of which passage is secured a detent mechanism 70 comprising a spring loaded ball that interacts with a curved rearward end 74 of a side 76 of the associated ice and beverage dispenser guide channel 68. To mount the drip tray 30 on the dispenser 20, rearward ends of the drip tray arms 50 carrying the detent mechanisms 70 are pushed into the dispenser guide channels 68. As the detent mechanisms balls contact the guide channel sides 76, they are moved inward against the force of their springs to enable the arms to enter the guide channels, following which they slide rearward along the sides 76 with continued movement of the drip tray arms into the guide channels. As the drip tray arms approach their full extension into the guide channels, at which point the drip tray has been moved to a point closely approaching the front of the dispenser, with full extension of the drip tray arms into the guide channels the balls are moved by their springs outwardly of the detent mechanisms and along the curved rearward ends 74 of the guide channel sides 76 to releasably latch the drip tray to the beverage dispenser. Because of the lengths of the drip tray arms 50 and the sturdy construction of the drip tray 30, the front of the dispenser can be lifted by lifting the drip tray. It is to be appreciated that attachment of the drip tray to the dispenser does not necessitate that the splash panel 28 first be removed, but instead can be performed while the splash panel remains in place on the dispenser.

To remove the drip tray 30 from the dispenser 20, it is only necessary to manually grip the drip tray and pull it forward and away from the dispenser with sufficient force to cause the balls of the detent mechanisms 70 to move inward against the force of their springs as they move over and past the curved inner ends 74 of the dispenser guide channel side walls 76. As is the case in mounting the drip tray on the dispenser, it is to be appreciated that removal of the drip tray from the dispenser also does not require prior removal of the dispenser splash panel 28. Thus, should it be necessary to obtain access to the interior of the dispenser housing 22, the drip tray can be removed before the splash panel is removed, thereby providing additional room for removing the splash panel and avoiding the potential for damage to the dispenser beverage dispensing valves 32 and/or the drip tray 30. Then, when it is time to close the front of the dispenser, the splash panel can be reattached to the dispenser without first attaching the drip tray, again avoiding the potential for damage to the beverage dispensing valves and drip tray.

Figures 5A, 5B, 5C, 5D, 5E:
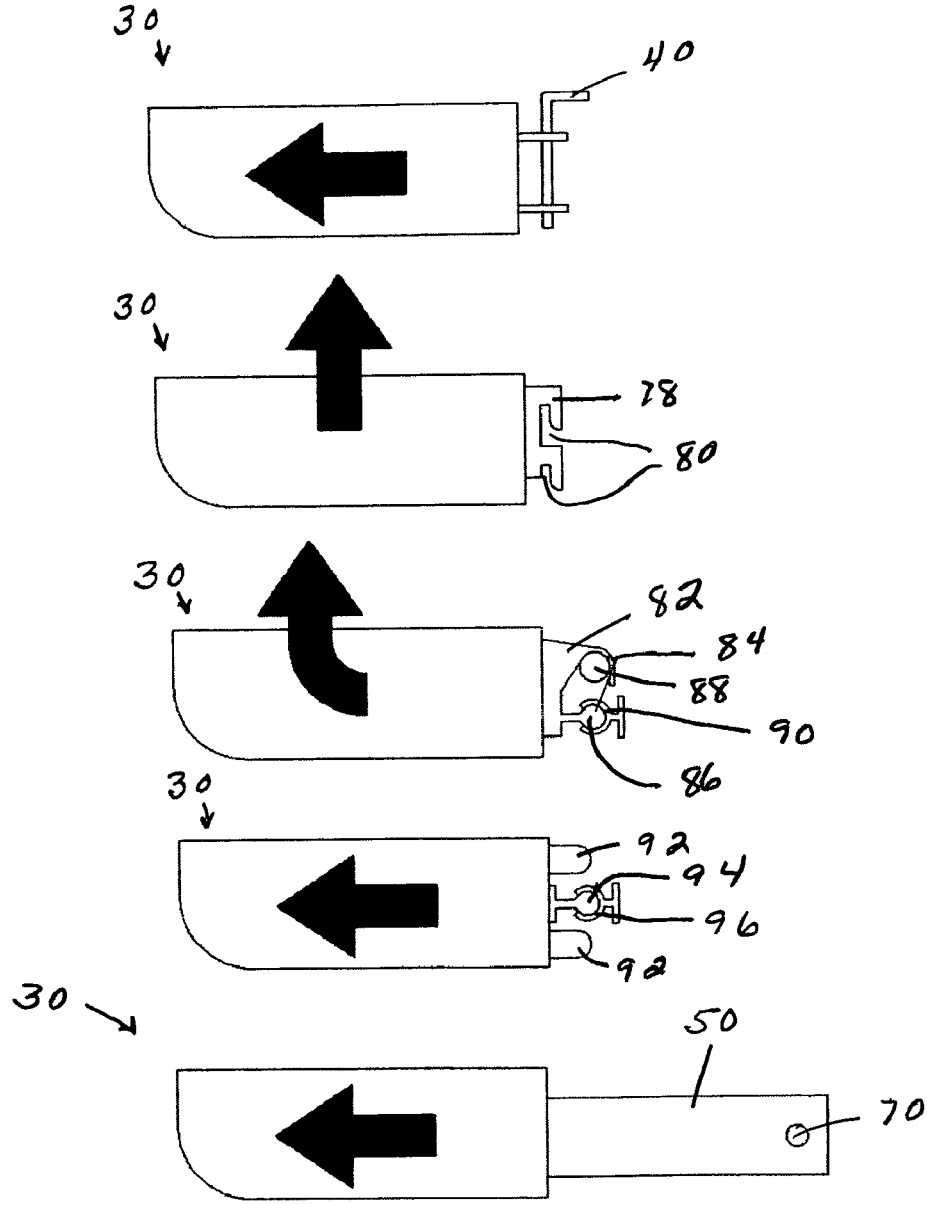
Fig. 5A (PRIOR ART)
FIG. 5A shows the conventional technique for securing a drip tray to a beverage dispenser.
FIGS. 5B-E show various techniques contemplated by the invention for releasably attaching a drip tray to a beverage dispenser.
Figure 6:
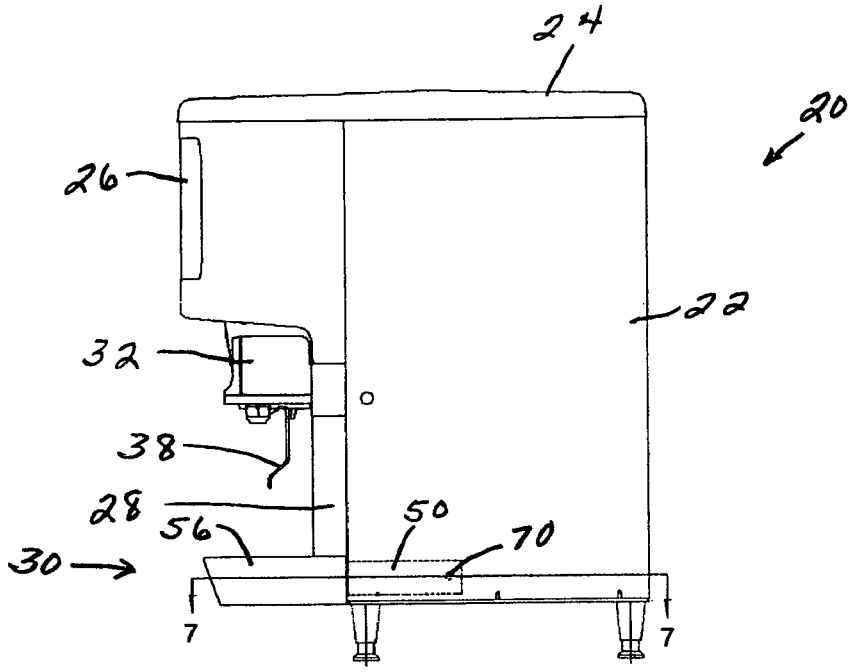
FIG. 6 is a side elevation view of an ice and beverage dispenser, showing a preferred technique contemplated by the invention for attaching a drip tray to the dispenser.
Figure 7:
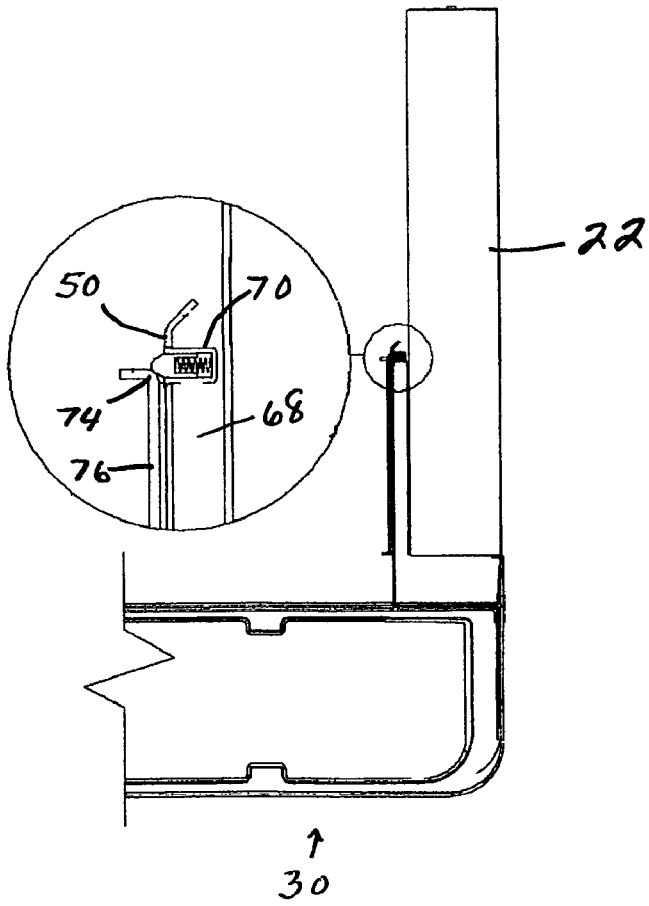
FIG. 7 is a cross-sectional view taken substantially along the lines 7-7 of FIG. 6.

Alternative embodiments contemplated by the invention, for releasably attaching the drip tray 30 to the ice and beverage dispenser 20, are shown in FIGS. 5B to 5D. In the embodiment of FIG. 5B, the back wall of the drip tray is provided with releasable latches 78 having slots 80 adapted to receive, for example, rods extending horizontally along a lower front portion of the dispenser, such that the drip tray may be removed from the dispenser by lifting it vertically, as shown by the arrow, and then pulling it away from the dispenser, and reattached by first moving it rearward to receive the rods in the slots and then vertically downward.

In FIG. 5C the back wall of the drip tray 30 is provided with a releasable latch 82 having an upper curved portion 84 defining a downward opening slot and a lower rod 86. The curved portion and rod extend along a length of the drip tray back wall, the slot receives a rod 88 attached to the lower front of and extending along a width of the dispenser 20 and the rod 86 is adapted to be received in a flexible clip 90 having a front opening and attached to a lower front of and extending along the width of the dispenser. In this embodiment, the drip tray is removed from the dispenser by lifting the front of the drip tray to rotate it about the rod 88 until its rod 86 is moved out of and released from the clip 90, and by then vertically lifting the drip tray to raise the upper curved portion 84 off of the rod 88. Replacement of the drip tray on the dispenser is accomplished by placing the upper curved portion 84 on the dispenser rod 88 and then rotating the front of the drip tray downward to move the drip tray rod 86 into the clip 90.

In the drip tray latching arrangement shown in FIG. 5D, the back wall of the drip tray 30 is provided with a plurality of guide tabs 92 for being received in associated passages in a front wall of the dispenser and with a rod 94 for being received in a flexible clip 96 carried by the dispenser. The flexible clip has a front opening and extends in a direction along the width of the dispenser, and the drip tray is removed from the dispenser by pulling the drip tray horizontally forward to move the drip tray rod 94 out of the dispenser clip 96 and the tabs 92 out of the associated dispenser passages. Replacement of the drip tray on the dispenser is accomplished by pushing the drip tray rearward toward the dispenser to move the tabs 92 into the associated dispenser passages and until the drip tray rod 94 is moved into the dispenser clip 96.

As for the FIG. 5E embodiment of drip tray releasable latching mechanism, in each of the embodiments of FIGS. 5B-5D the releasable latching mechanisms permit removal and replacement of the drip tray 30 from and on the dispenser 20 while the splash panel 28 remains mounted on the dispenser. Thus, after the drip tray is removed, the splash panel can be removed from and then replaced on the dispenser without the potential for damage to the beverage valves and/or the drip tray.

While embodiments of the invention have been described in detail, various modifications and other embodiments thereof may be devised by one skilled in the art without departing from the spirit and scope of the invention, as defined in the appended claims.

What is claimed is:

1. A beverage dispenser, comprising:

a housing;

a beverage dispensing valve on a front of said housing;

a splash panel removably mounted on said housing front below said beverage valve;

a drip tray removably mounted on said housing front beneath said beverage valve and said splash panel by releasable attaching means, such that said drip tray can be mounted on and dismounted from said housing while said splash panel remains mounted on said housing;

wherein said releasable attaching means includes at least one member attached to a lower front portion of said dispenser below said splash plate and at least one latch attached to a rearward end of said drip tray, said at least one latch having at least one L-shaped slot opening at a rearward end of said at least one latch and adapted to receive said at least one member therein, such that said drip tray is detached from said dispenser by lifting said drip tray vertical relative to said dispenser and then pulling said drip tray forward away from said dispenser to move said at least one member through and out of said at least one slot, and such that said drip tray is reattached to said dispenser by moving said drip tray rearward and then vertically downward to move said at least one member into and through said at least one slot.

2. A beverage dispenser, comprising:

a housing;

a beverage dispensing valve on a front of said housing;

a splash panel removably mounted on said housing front below said beverage valve;

a drip tray removably mounted on said housing front beneath said beverage valve and said splash panel by releasable attaching means, such that said drip tray can be mounted on and dismounted from said housing while said splash panel remains mounted on said housing; and a valve actuating arm coupled to and for controlling said dispensing valve and extending downward from said valve at least partially across a front of said splash panel, whereby upon removal of said drip tray from said housing said splash panel can be removed by being moved downward through a space previously occupied by said drip tray without contacting either said valve actuating arm or said drip tray, wherein said releasable attaching means comprises a latch on a rearward side of said drip tray having a slot and a rod, and a clip and a member on a lower front portion of said dispenser below said splash panel, said member being received in said slot and said rod being received by said dispenser clip to mount said drip tray on said dispenser, said drip tray being removable from said dispenser, while said splash panel remains on said dispenser, by lifting a front end of said drip tray to detach said rod from said clip and by then raising a rearward end of said drip tray to separate said slot from said member.

3. A beverage dispenser comprising:

a housing;

a beverage dispensing valve on a front of said housing;

a splash panel removably mounted on said housing front below said beverage valve; and a drip tray removably mounted on said housing front beneath said beverage valve and said splash panel by releasable attaching means, such that said drip tray can be mounted on and dismounted from said housing while said splash panel remains mounted on said housing, wherein said releasable attaching means comprises a guide means and a rod on a rearward side of said drip tray, and a clip and guide means receiving means on a lower front portion of said dispenser beneath said splash panel, said rod being received by said clip and said guide means being received by said guide means receiving means to mount said drip tray on said dispenser, said drip tray being removable from said dispenser, while said splash panel remains on said dispenser, by moving said drip tray forward to detach said rod from said clip and to move said guide means away from said guide means receiving means.

4. A beverage dispenser, comprising:

a housing;

a beverage dispensing valve on a front of said housing;

a splash panel removably mounted on said housing front below said beverage valve; and a drip tray removably mounted on said housing front beneath said beverage valve and said splash panel by releasable attaching means, such that said drip tray can be mounted on and dismounted from said housing while said splash panel remains mounted on said housing, wherein said releasable attaching means comprises interacting means on each of a rearward side of said drip tray and a forward side of said dispenser housing for releasably attaching said drip tray to said housing while said splash panel is on said housing, such that upon manually moving said drip tray toward said housing said interacting means on each of said drip tray and housing is engaged to releasably attach said drip tray to said housing, and upon manually moving said drip tray away from said housing said interacting means on each of said drip tray and housing is disengaged to permit removal of said drip tray from said housing, and wherein said interacting means includes spring loaded ball means on one of said drip tray and dispenser housing and detent means on the other of said drip tray and dispenser housing.

5. A beverage dispenser as in claim 4, said housing having at least one channel extending rearward from a front thereof and said drip tray having at least one arm extending rearward from a rear side thereof, said spring loaded ball means being associated with one of, and said detent means being associated with the other of, said at least one housing channel and said at least one drip tray arm.

6. A beverage dispenser, comprising:

a housing;

a beverage dispensing valve on a front of said housing;

a splash panel removably mounted on said housing front below said beverage valve; and a drip tray removably mounted on said housing front beneath said beverage valve and said splash panel by releasable attaching means, such that said drip tray can be mounted on and dismounted from said housing while said splash panel remains mounted on said housing, wherein said dispenser housing has a pair of laterally spaced guide channels extending rearward from a front of said housing, said drip tray has a pair of arms extending rearward from a back of said drip tray and extendable into associated ones of said housing guide channels upon movement of said drip tray toward said housing, and said releasable attaching means comprising means on each of said drip tray arms and dispenser housing guide channels for releasably attaching said drip tray to said housing when said arms are extended into said guide channels and for releasing said drip tray from said housing when said arms are pulled out of said guide channels.

* * * * *